United States Patent [19]

Sato

[11] 4,027,129

[45] May 31, 1977

[54] PUSH BUTTON SWITCH

[75] Inventor: Zenkei Sato, Hachioji, Japan

[73] Assignee: Giko Kabushiki Kaisha, Tokyo, Japan

[22] Filed: Sept. 30, 1974

[21] Appl. No.: 510,730

[52] U.S. Cl. ..... 200/159 A; 200/239; 200/6 BB

[51] Int. Cl.[2] ..... H01H 3/14

[58] Field of Search ..... 200/159 A, 159 B, 159 R, 200/6 BB, 6 C, 5 A, 153 V, 283, 239

[56] References Cited

UNITED STATES PATENTS

| | | | |
|---|---|---|---|
| 3,586,810 | 6/1971 | Brown | 200/153 V X |
| 3,632,909 | 1/1972 | Rowley | 200/283 |
| 3,681,723 | 8/1972 | Goll | 200/159 B X |
| 3,731,014 | 5/1973 | Brady | 200/5 A |
| 3,757,069 | 9/1973 | Reuting | 200/283 |
| 3,767,875 | 10/1973 | Schneikart et al. | 200/159 B X |
| 3,773,998 | 11/1973 | Seeger et al. | 200/153 V X |
| 3,786,205 | 1/1974 | Lien | 200/159 A X |
| 3,818,169 | 6/1974 | Kobernus | 200/159 A |
| 3,826,882 | 7/1974 | Giolitti et al. | 200/5 A |
| 3,829,632 | 8/1974 | Klehm | 200/5 A |
| 3,858,019 | 12/1974 | Muri et al. | 200/159 A |

*Primary Examiner*—Herman J. Hohauser
*Attorney, Agent, or Firm*—Diller, Brown, Ramik & Wight

[57] ABSTRACT

The push button switch according to the invention comprises a push button, a press member operated by the push button, a stationary contact member secured to a substrate and a movable contact member operated by the press member. One end of the movable contact member is shaped to engage the stationary contact member with a line contact whereby positive and low resistance contact is ensured. Further, a cushion member in the form of a resilient pad or spring is interposed between the press member and the push button for alleviating the shock created when the push button is depressed.

1 Claim, 3 Drawing Figures

PUSH BUTTON SWITCH

DETAILED DESCRIPTION OF THE INVENTION

This invention relates to a push button switch, and more particularly, to the improvement of the contact mechanism thereof.

Various types of mechanical contact mechanisms have been proposed for use in push button switches which are used as key board switches of table type electronic calculators and the like. However, in the prior art contact mechanism, both movable and stationary contacts are constructed as point contacts so that the contact conditions are often impaired due to accumulation of dust or corrosion of the contacts.

According to this invention, the difficulty described above is eliminated by providing a line contact between the movable contact and the stationary contact. Such a line contact provides a larger contact area between the stationary and movable contacts than the point contact, thus assuring positive and low resistance contact irrespective of a certain degree of deposition of dust and corrosion.

More particularly, in accordance with this invention there is provided a push button switch comprising a push button, a press member operated by the push button, a stationary contact member secured to a substrate, a movable contact member operated by the press member, one end of the movable contact member being shaped to engage the stationary contact member with a line contact and the other end of the movable contact member being secured to the substrate. Further, for the purpose of alleviating the shock created when the push button is depressed, a cushion member in the form of a resilient pad or spring is interposed between the press member and the push button.

The invention can be more fully understood from the following detailed description taken in conjunction with the accompanying drawing in which.

Figure 1:
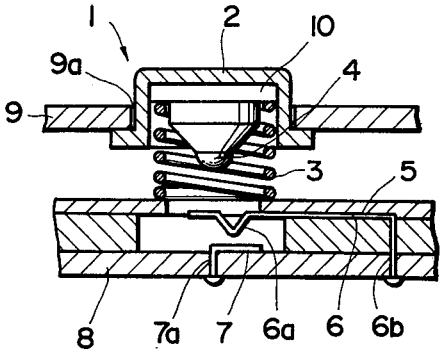
FIG. 1 is a sectional view showing one example of the improved contact mechanism.

Referring now to FIG. 1 of the accompanying drawing, the push button switch 1 shown therein comprises a key top or an inverted dish shaped button 2, a press member 4 contained in the button 2, a return spring 3 for biasing the button 2 in the upward direction, a movable contact piece 6, a stationary contact piece 7, a printed board or substrate 8, and a cover plate 9 provided with an opening 9*a* for slidably receiving the button 2. The return spring 3 is interposed between the button 2 and a supporting plate 5 to surround the press member 4. The press member 4 is made of a relatively hard plastic or the like and is fastened to the key top 2 through a cushion member 10 which has a shape of a plate and is made of rubber or the like, so that the press member 4 is moved together with the press top for controlling the opening and closing of contact members 6 and 7.

The purpose of cushion member 10 is to alleviate the impact of the press member 4 upon the movable contact member 6 so as to prevent the damage thereof even when the key top 2 is depressed with a large force.

Figure 2:
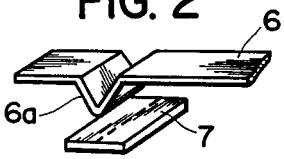
FIG. 2 shows a perspective view of the stationary and movable contacts.

The movable contact member 6 is made of a strip of electroconductive material having resiliency sufficient to follow the vertical movement of the press member 4. As shown in FIG. 2, the contact member 6 is provided at its one end with a projection 6*a* which is formed by folding the contact member 6 to form a triangular groove. The other end 6*b* of the contact member 6 extends through the printed board and secured thereto by any suitable means such as soldering. The lead 7*a* of the stationary contact 7 is also made of a metal strip and secured to the printed board 8 in the same manner.

When the key top 2 is depressed, the knife edge shaped projection 6*a* is urged against the stationary contact member 7 thus closing the circuit. As shown by dotted lines in FIG. 2, since the contact between the stationary contact and the movable contact is made along a line, a wider contact area than a point contact is ensured. Consequently, even when the contact at a certain point is prevented due to accumulation of dust or corrosion, a sufficiently good contact can be obtained. When compared with a plane contact the line contact provides larger contact pressure thus decreasing contact resistance.

When the key top 2 is released, the return spring 3 moves upwardly the key top 2 together with the push member 4 thus permitting the movable contact member 6 to disengage from the stationary contact member 7 under its own resiliency.

It should be understood that the configuration of the projection 6*a* of the movable contact member is not limited to a sharp knife edge shape but the edge may be rounded so long as the desired line contact can be assured. The horizontal portion of the stationary contact member 7 may be slightly spaced from the upper surface of the printed board 8 so as to permit a slight wiping action to the stationary contact member.

Figure 3:
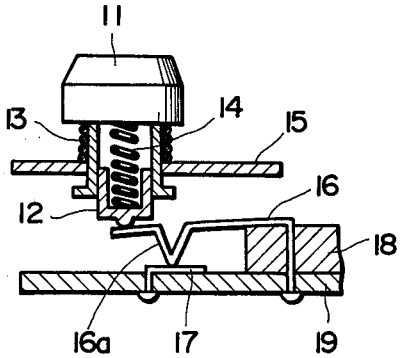
FIG. 3 shows a sectional view of a modified contact mechanism.

In the modified embodiment of this invention shown in FIG. 3, the movable contact member 16 and the stationary contact member 17 are identical to those used in the first embodiment. The push button comprises a key top 11 extending through the opening of a cover plate 15, a return spring 13 interposed between the key top 11 and the cover plate 15, a push member 12 slidably received in the cylindrical stem of the kep top 11 and a cushion spring 14 connecting the push member 12 to the key top 11. The cushion spring 14 functions in the same manner as the cushion member 10 of the first embodiment. In the embodiment shown in FIG. 3, the supporting plate 5 is omitted and one end of the stationary contact member 16 is extended through an insulating support 18 and then connected to a printed substrate 19. Thus, as the other end of the movable contact member 16 is depressed by the press member 12, the knife edge projection 16*a* engages the stationary contact member 17 thus closing the circuit.

As has been described hereinabove, according to this invention the electrical contact between the stationary and movable contacts is provided by a line contact with a resulting low resistance contact irrespective of the accumulation of dust and corrosion of a portion of the contact. Moreover, as a cushion member is interposed between the push button and the press member for the movable contact it is possible to alleviate the shock which is generated when the push button is depressed.

What is claimed is:

1. A push button switch comprising a push button, said push button being of an inverted cup-shaped configuration, a press member housed within and operated by said push button, a cover plate having an aperture telescopically receiving said push button, a substrate beneath and spaced from said plate, a stationary contact member carried by said substrate, a cantilevered flexible contact member carried by said substrate and being disposed above said stationary contact member, said push button, press member and flexible contact member being in alignment whereby upon the depression of said push button said press member contacts and deflects said flexible contact member into contact with said stationary contact member, said flexible contact member having an end including means for providing straight line contact with said stationary contact member, spring means disposed between said push button and said substrate for normally biasing said push button in a direction away from said substrate, said inverted cup-shaped push button being defined by an end wall and a peripheral skirt, said spring means being in external telescopic relationship to said press member, a cushion member seated between said end wall and said press member, said substrate including a cover plate, and said spring means being disposed between said last-mentioned cover plate and said end wall.

* * * * *